US009210777B2

(12) United States Patent
Gritti

(10) Patent No.: US 9,210,777 B2
(45) Date of Patent: Dec. 8, 2015

(54) METHOD FOR DETECTING AND CONTROLLING CODED LIGHT SOURCES

(71) Applicant: KONINKLIJKE PHILIPS N.V., Eindhoven (NL)

(72) Inventor: Tommaso Gritti, Breda (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/372,867

(22) PCT Filed: Jan. 8, 2013

(86) PCT No.: PCT/IB2013/050140

§ 371 (c)(1),
(2) Date: Jul. 17, 2014

(87) PCT Pub. No.: WO2013/108148

PCT Pub. Date: Jul. 25, 2013

(65) Prior Publication Data

US 2015/0002026 A1 Jan. 1, 2015

Related U.S. Application Data

(60) Provisional application No. 61/588,711, filed on Jan. 20, 2012.

(51) Int. Cl.
*H05B 37/02* (2006.01)
*H05B 41/32* (2006.01)

(52) U.S. Cl.
CPC ..... *H05B 37/0245* (2013.01); *H05B 37/0272* (2013.01); *H05B 41/32* (2013.01)

(58) Field of Classification Search
CPC ..... H05B 41/325; H05B 41/3922; H05B 37/0272; H05B 37/029; G03B 15/05
USPC ..... 315/149, 151–154, 312, 323, 324
See application file for complete search history.

(56) References Cited

U.S. PATENT DOCUMENTS

| | | | | |
|---|---|---|---|---|
| 2005/0248299 | A1* | 11/2005 | Chemel et al. | 315/312 |
| 2010/0271476 | A1* | 10/2010 | Damink et al. | 348/135 |
| 2014/0265878 | A1* | 9/2014 | Gritti | 315/153 |
| 2015/0061509 | A1* | 3/2015 | Karlicek et al. | 315/153 |

FOREIGN PATENT DOCUMENTS

| | | | |
|---|---|---|---|
| WO | WO2007095740 | A1 | 8/2007 |
| WO | WO2010079400 | A1 | 7/2010 |
| WO | WO2011073881 | A1 | 6/2011 |

OTHER PUBLICATIONS

Abramson N. et al., "The ALOHA System—Another Alternative for Computer Communications", Proceedings Fall Joint Computer Conference, AFIPS Press, pp. 281-285, 1970.
"Manual for uEye Cameras", IDS Imaging Development Systems GmbH, v. 3.50.00, Oct. 2009.

* cited by examiner

*Primary Examiner* — Dylan White
(74) *Attorney, Agent, or Firm* — Meenakshy Chakravorty

(57) ABSTRACT

A light source control method using a light detector including an image sensor, a display, a user interface, and a decoder, The includes performing a capturing sequence, which includes capturing an image of a set of light sources and displaying the image; requesting a user to point the light detector at a subset of light sources, and capturing a sub-image for each pointing; and, for each sub-image, detecting individually coded light emitted from any light source. The method also includes performing a selection sequence by displaying a panoramic image and receiving user input representing user selection of a portion of the panoramic image. The method further includes performing a control sequence by controlling at least one light source emitting individually coded light having influence on the selected portion.

7 Claims, 3 Drawing Sheets

METHOD FOR DETECTING AND CONTROLLING CODED LIGHT SOURCES

CROSS-REFERENCE TO PRIOR APPLICATIONS

This application is a U.S. national stage application under 35 U.S.C. §371 of International Application No. PCT/IB2013/050140, filed on Jan. 8, 2013, which claims priority benefit under 35 U.S.C. §119(e) of U.S. Provisional Application No. 61/588,711 filed on Jan. 20, 2012, the contents of which are herein incorporated by reference.

FIELD OF THE INVENTION

The present invention relates to a light source control method for detecting and controlling light sources, which emit individually coded light.

BACKGROUND OF THE INVENTION

A method for detecting and controlling light sources by means of coded light generally involves the use of a light detector arranged to detect individually coded light emitted from a light source. Such a light detector is typically based on the use of a single photo detector, typically a photodiode, to capture the light and convert it into an electrical signal to be further processed. The light detector is typically equipped with a large bandwidth optimal signal detection, but offer in certain application scenarios a limiting user experience in order to get a good detection. The user has to point very accurately, sniper-like. The latter is due to the fact that, in order to avoid cross-talk between lamps, the light detector is equipped with optics that limit its Field of View (FOV) and aperture in order to ensure that substantially the light from only one lamp reaches the photo detector. Thus, the method involves an uncomfortable and sometimes even a bit tricky operation of requiring the user to aim very accurately.

SUMMARY OF THE INVENTION

It is an object of the present invention to provide a method that alleviates the above-mentioned problems of the prior art and does not require a light detector having such a limited FOV for its performance.

The object is achieved by a light source control method according to the present invention as defined in claim 1.

The invention is based on the insight that by interacting with the user via a display for displaying images of the light sources, the requirement of accurate pointing can be relaxed.

Thus, in accordance with an aspect of the present invention, there is provided a light source control method using a light detector comprising an image sensor, a display, a user interface, and a decoder, the light source control method comprising:

performing a capturing sequence, comprising capturing an image of a set of light sources and displaying the image; requesting a user to point the light detector at at least a subset of the set of light sources, one light source at a time; capturing a sub-image for each pointing; and, for each sub-image, detecting individually coded light emitted from any light source emitting individually coded light and being present in the sub-image;

performing a selection sequence comprising displaying a panoramic image showing a combination of the sub-images and information related to decoded light sources overlaid on the corresponding light sources in the panoramic image; and receiving user input representing user selection of a portion of the panoramic image; and performing a control sequence comprising controlling at least one light source emitting individually coded light having influence on the selected portion.

In the context of the present invention, "coded light" refers to light emitted by a light source for illumination of objects in an environment of the light source, which light emitted comprises embedded data invisible to the human eye, such as data relating to the light source, f.i. a light source ID or operating parameters of the light source (voltage, current, power, colour point, cumulative burning time, etc).

In accordance with an embodiment of the method, the operation of performing a selection sequence comprises requesting the user to select a single light source in the displayed image.

In accordance with an embodiment of the method, the operation of performing a selection sequence comprises displaying information related to decoded light sources overlaid on the corresponding light sources in the panoramic image.

In accordance with an embodiment of the method, the information related to decoded light sources comprises at least one of light source identification, and control data.

In accordance with an embodiment of the method, the operation of performing a selection sequence comprises automatically selecting the light source having the strongest influence on the selected portion as the light source to be controlled.

In accordance with an embodiment of the method, the operation of performing a selection sequence comprises displaying a list of light sources having influence on the selected portion, ordered according to their influence and receiving user input selecting one of the light sources.

In accordance with an embodiment of the method, the operation of performing a capturing sequence comprises storing information about the light sources in conjunction with position coordinates on the image.

In accordance with an embodiment of the method, the operation of performing a selection sequence comprises determining the influence of each light source emitting coded light as a weighted sum of its influence in all sub-images.

These and other aspects, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
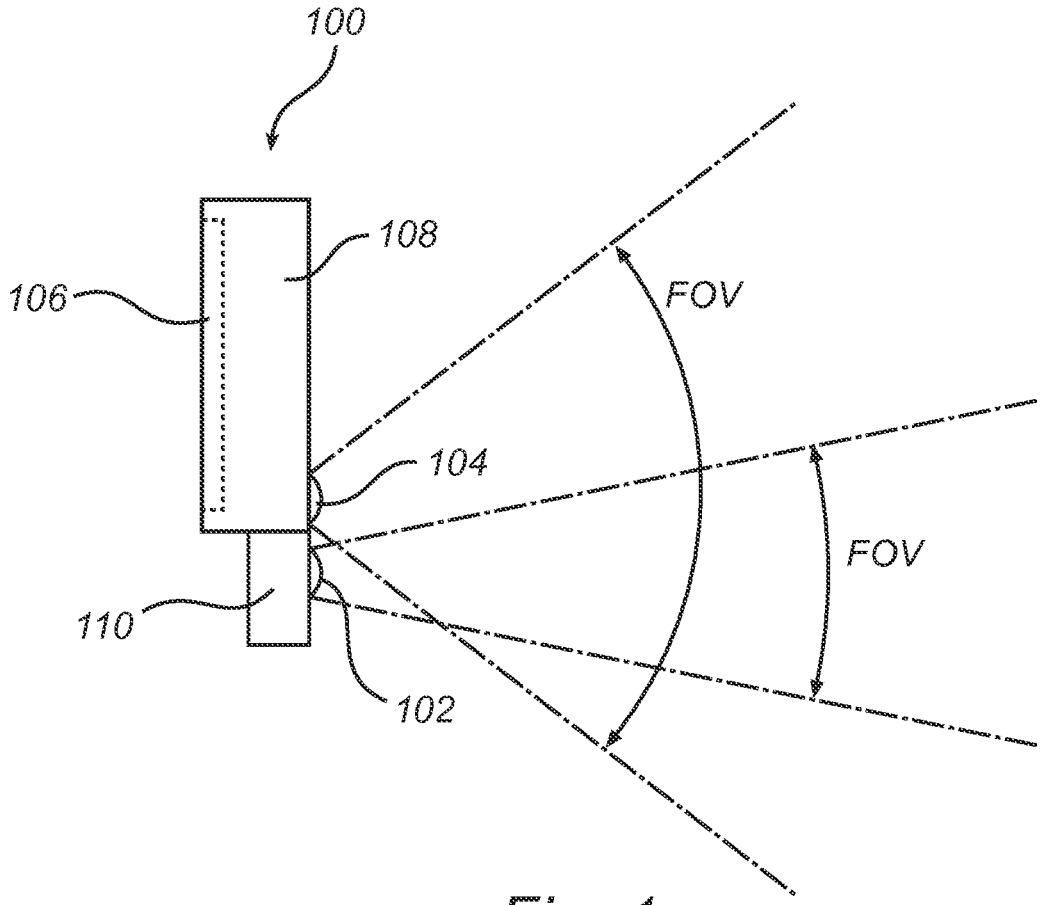
FIG. 1 schematically shows a side view of an embodiment of a light detector which is used by the method.

The light source control method is performed by means of a light detector, an exemplifying embodiment of which is shown in FIG. 1. The light detector 100 comprises a photo detector 102, which is arranged to detect coded light, an image sensor 104, and a screen 106. A field of view (FOV) of the photo detector 102 is within the FOV of the image sensor 104. That is, the FOV of the photo detector 102 is narrower than the FOV of the image sensor 104, and the photo detector 102 and the image sensor 104 are pointed in the same direction. More particularly, the FOV of the photo detector 102 has been chosen to be very narrow in comparison with the FOV of the image sensor 104. This allows for a higher selectivity, which is particularly useful in cases in which there are several light sources in the image captured by the image sensor 104, which appear close together from the observation point.

According to this embodiment, the image sensor 104 and the screen 106 are comprised in a separate first unit 108, such as a smartphone, where the image sensor 104 is an ordinary built in camera arranged at a rear side of the smartphone 108, and the screen 106 is an ordinary screen on the front side of the smartphone 108. The photo detector 102 is comprised in a separate second unit 110. The smartphone 108 has been adapted, primarily by added software, to be connected with the second unit 110, which in turn has been designed to be physically and electrically interconnectable with the smartphone 108.

Figure 2:
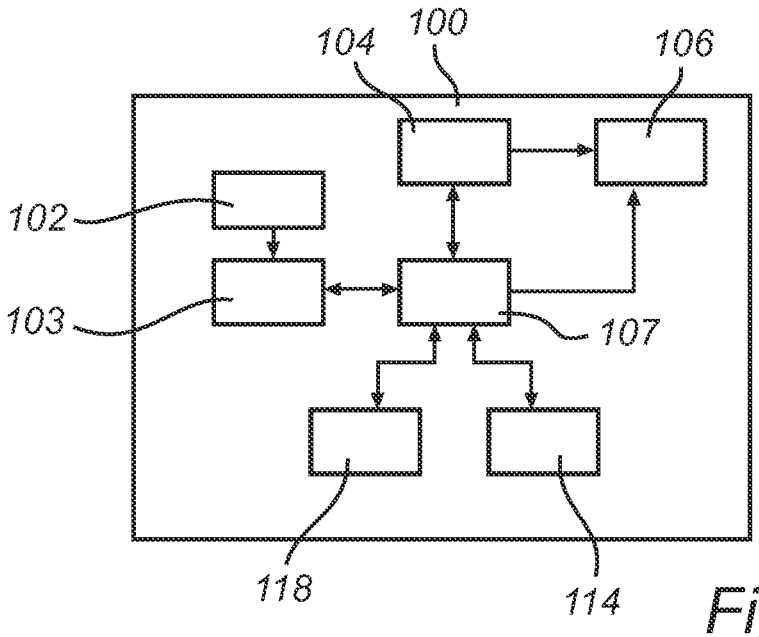
FIG. 2 is a block diagram of the light detector shown in FIG. 1.
Figure 3:
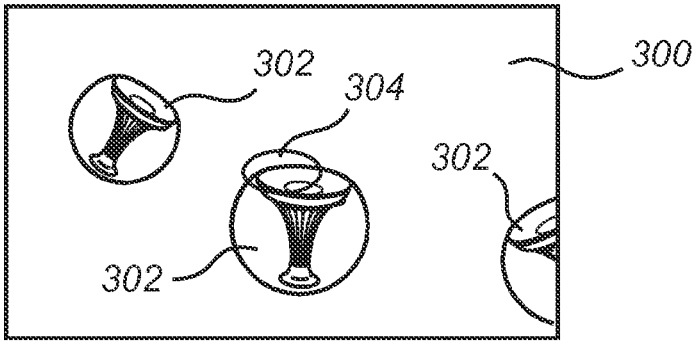
FIG. 3 illustrates an example of a detected image.
Figure 4:
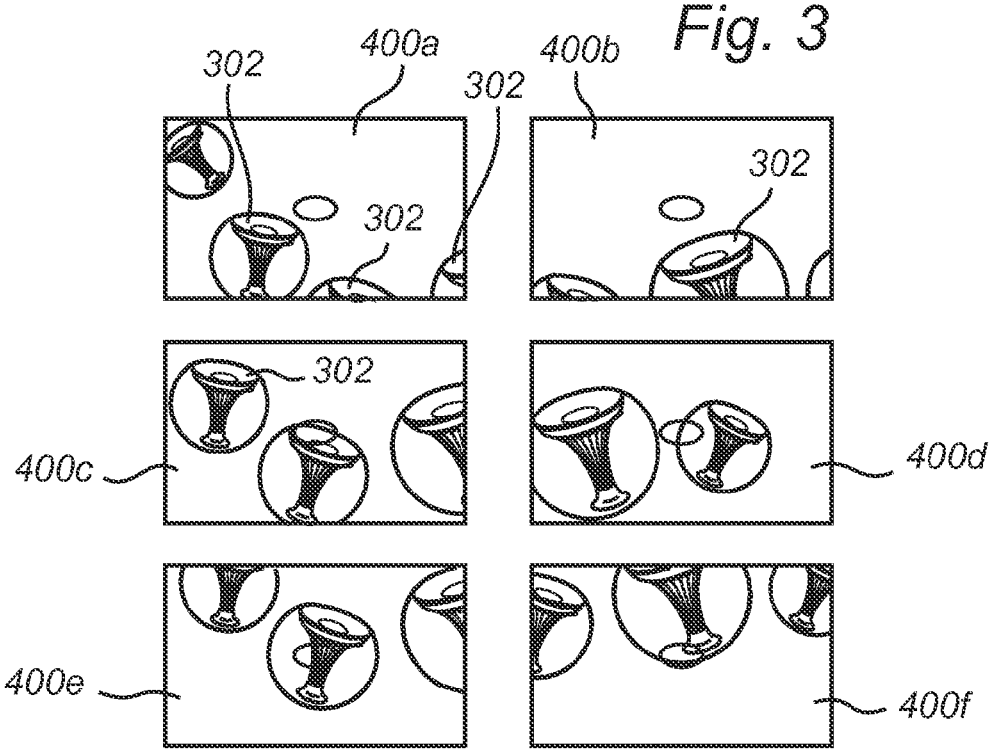
FIG. 4 illustrates examples of sub-images related to the detected image of FIG. 3.
Figure 5:
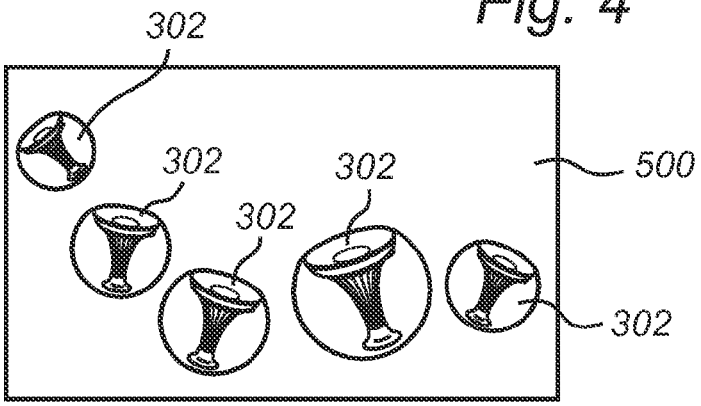
FIG. 5 illustrates a panoramic image being a combination of the sub-images of FIG. 4.

Illustrated by a block diagram in FIG. 2, the light detector 100 comprises a photo detector 102, a light decoder 103, an image sensor 104, a screen 106, and a control unit 107. The photo detector 102 is aligned with the image sensor 104 such that the remote position detected at the centre of the image sensor 104, and thus appearing at the centre of the FOV of the screen 106 is also at the centre of the FOV of the photo detector 102. The alignment typically means that the FOV of the photo detector 102 is embraced by the FOV of the image sensor 104 at a distance from the light detector 100, but not close to the light detector 100, since the photo detector 102 and the image sensor are physically placed side by side, and not on top of each other, which is however obvious to a person skilled in the art, and which is no disadvantage in practise. Furthermore, the light detector 100 comprises a user interface UI 114, which is displayed on the screen 106 as a touch sensitive input member, and a data acquisitor 118. The data acquisitor 118 is arranged to acquire and store data about light sources the light of which has been decoded, as well as image data captured by the image sensor.

According to an embodiment of the light source control method it comprises performing a capturing sequence 801, wherein first an image 300 of a set of light sources 302 is captured by means of the light detector 100, and displayed on the display 106. That is, the user points at an area where at least one light source 302 is mounted, and the image of that area is captured. The photo detector 102 extracts codes in the light of one or more light sources 302 which are present within its FOV 304, and the codes are stored in the memory of the data aquisitor 118 together with a coordinate on the image captured by the image sensor 104. Computer vision algorithms are useful for determining the positions within the image, i.e. the coordinate. When a set of light sources comprising more than one light source 302 is present in the image 300, according to this method a further investigation is offered in order to ensure that the most appropriate light source 302 is chosen for control, e.g. adjustment of its light settings. Thereby, the user does not have to point extremely accurately at a specific light source. Therefore, next the user is requested, e.g. by means of a message on the display 106, to point the light detector 100 at all light sources of the set of light sources 302, or at least a subset thereof, one light source 302 at a time. A sub-image 400*a*-400*f* is captured with the image sensor 104 for each pointing. The user is allowed to determine how many, if any, of the light sources 302 to point at. For each sub-image 400*a*-400*f*, individually coded light emitted from any of the light sources 302, which are present in the sub-image, is detected.

Figure 6:
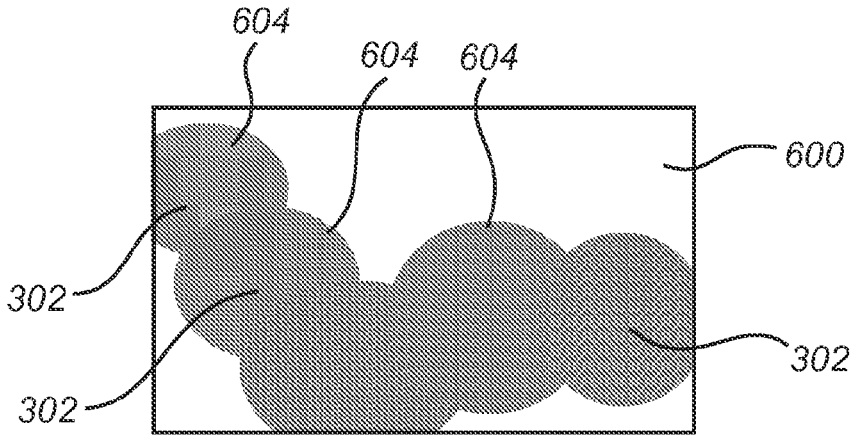
FIGS. 6 and 7 illustrate displaying of detected light source data overlaid on the panoramic image of FIG. 5.

Next operation is to perform a selection sequence 802 for selecting which light source 302 to actually control. The selection sequence comprises displaying a panoramic image 500 constituting a combination of the sub-images 400*a*-400*f*, and information related to decoded light sources overlaid on the corresponding light sources in the panoramic image. The panoramic image with an overlay is shown in FIG. 6 at 600. That is, the captured and stored sub-images are joined by means of image data processing, and the acquired data about the light sources emitting individually coded light is presented on the display as well in front of the image on the light sources and located with the respective light source 302. The panoramic image 600 shows all light sources 302 that have been visible in the sub-images 400*a*-400*f*. The information typically represents the codes of the light sources, i.e. an identification ID of the light sources 302. For instance, each ID is given a different colour 604 for ease of visualisation, and is presented as a coloured spot in front of the respective light source 302. Alternatively, or additionally an ID number is presented, and/or control data, such as light settings etc., related to the respective light sources 302. Then the user is prompted to input a selection of a portion of the panoramic image 600. The input is made either via the user interface 114, such as an ID number, or, preferably, by the user clicking on the display 106, i.e. in the image 600, at the portion the user wishes to be controlled. In the latter case, the user can either click on a limited point shaped portion or encircle a larger area portion of the panoramic image 600.

Figure 7:
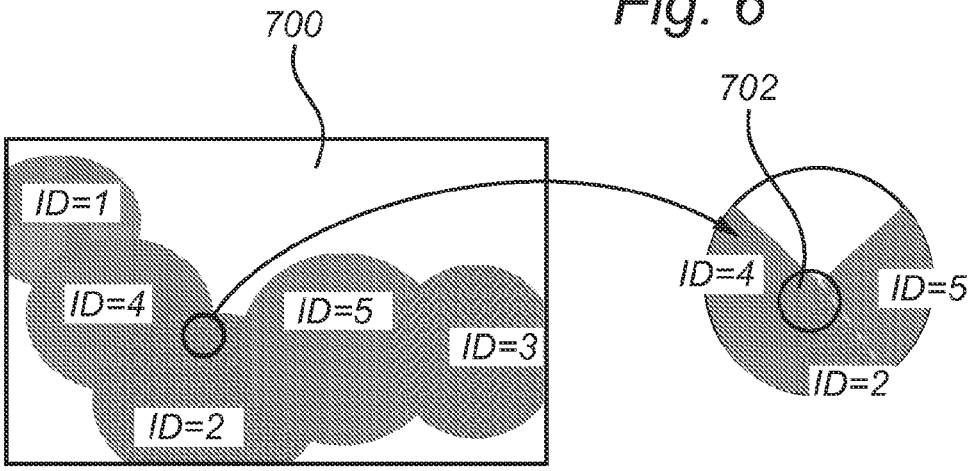
Figure 8:
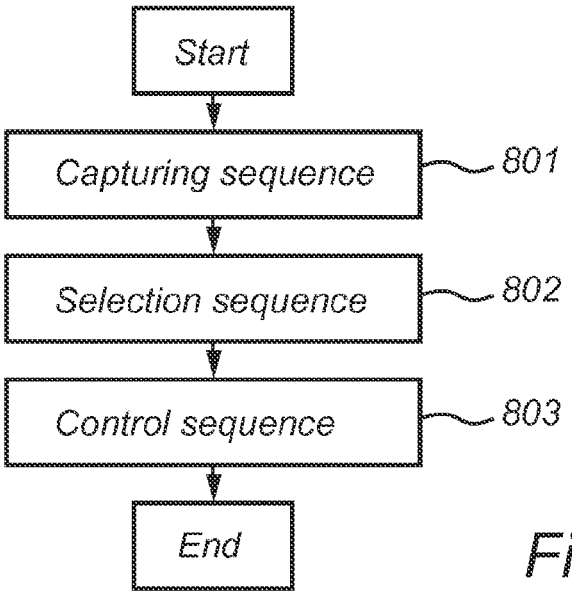
FIG. 8 is a flow chart of an embodiment of the method according to the present invention.

The user input is processed in one of several alternative ways. According to one alternative, a list of light sources having influence on the selected portion, are displayed ordered according to their level of influence. According to another alternative, the light source having the strongest influence on the selected portion is automatically selected as the light source to be controlled. This is illustrated in FIG. 7 where the extracted circle 702 represents the portion selected by the user, and where light source No. 4 is determined to have the highest level of influence within the selected portion. Thus, light source No. 4 is automatically selected.

As a further alternative, the level of influence of each light source emitting coded light is determined as a weighted sum of its influence in all sub-images. The weighting is done according to some appropriate algorithm. The simplest algorithm is the sum of the number of times a given code has been detected in a sub-image. A more advanced approach would take into consideration the confidence in the detection of the code, if available from the signal decoding performed by the photo detector in conjunction with the light decoder.

Finally, there is performed a control sequence 803 comprising controlling at least one light source emitting individually coded light having influence on the selected portion. For example, this controlling comprises adjusting one or more lighting characteristics of the selected light source or light sources. Typically, the brightness is adjusted. Another example of characteristics is light colour.

The present light source control method is applicable to other light detectors as well. One example thereof is a light detector, which is similar to the one described above. However, it lacks a photo detector. On the other hand the image sensor used to capture the overview has sequential line readout characteristics, also known as rolling shutter, by means of which it is possible to detect several different light sources in the image captured by the image sensor. The image is acquired by a plurality of temporal shifted line instances, each comprising an instance of the temporal sequence of modulations of a code. Thus, the temporal shifted line instances serve as light sample moments. Thereby, it is possible to decode the received light.

Above embodiments of the light source control method according to the present invention as defined in the appended claims have been described. These should only be seen as merely non-limiting examples. As understood by the person skilled in the art, many modifications and alternative embodiments are possible within the scope of the invention as defined by the appended claims.

It is to be noted that for the purposes of his application, and in particular with regard to the appended claims, the word "comprising" does not exclude other elements or steps, and the word "a" or "an" does not exclude a plurality, which per se will be evident to a person skilled in the art.

The invention claimed is:

1. A light source control method using a light detector comprising an image sensor, a display, a user interface, and a decoder, the light source control method comprising:

performing a capturing sequence comprising capturing an image of a set of light sources and displaying the image;

requesting a user to point the light detector at least a subset of the set of light sources, one light source at a time;

capturing a sub-image for each pointing;

for each sub-image, detecting individually coded light emitted from any light source emitting individually coded light and being present in the sub-image;

performing a selection sequence comprising displaying a panoramic image showing a combination of the sub-images and information related to decoded light sources overlaid on the corresponding light sources in the panoramic image;

receiving user input representing user selection of a portion of the panoramic image; and performing a control sequence comprising controlling at least one light source emitting individually coded light having influence on the selected portion.

2. The light source control method according to claim 1, said performing a selection sequence comprising requesting the user to select a single light source in the displayed panoramic image.

3. The light source control method according to claim 1, wherein said information related to decoded light sources comprises at least one of light source identification, level of influence of the light source, and control data.

4. The light source control method according to claim 1, said performing a selection sequence comprising automatically selecting the light source having the strongest influence on the selected portion as the light source to be controlled.

5. The light source control method according to claim 1, said performing a selection sequence comprising displaying a list of light sources having influence on the selected portion, ordered according to their level of influence and receiving user input selecting one of the light sources.

6. The light source control method according to claim 1, said performing a capturing sequence comprising storing information about the light sources in conjunction with position coordinates on the image.

7. The light source control method according to claim 1, said performing a selection sequence comprising determining the level of influence of each light source emitting coded light as a weighted sum of its influence in all sub-images.

* * * * *